US005801734A

United States Patent [19]

Schneider

[11] Patent Number: 5,801,734

[45] Date of Patent: Sep. 1, 1998

[54] TWO ROW FLAT FACE CHARGING FOR HIGH RESOLUTION PRINTING

[75] Inventor: John M. Schneider, Dayton, Ohio

[73] Assignee: Scitex Digital Printing, Inc., Dayton, Ohio

[21] Appl. No.: 577,223

[22] Filed: Dec. 22, 1995

[51] Int. Cl.[6] ..... B41J 2/09

[52] U.S. Cl. ..... 347/77; 347/76

[58] Field of Search ..... 347/74, 75, 76, 347/77, 90

[56] References Cited

U.S. PATENT DOCUMENTS

| | | | |
|---|---|---|---|
| 4,085,409 | 4/1978 | Paranjpe | 347/77 |
| 4,122,458 | 10/1978 | Paranjpe | 347/77 |
| 4,307,407 | 12/1981 | Donahue et al. | 347/74 |
| 4,510,503 | 4/1985 | Paranjpe et al. | 347/14 |
| 4,533,925 | 8/1985 | Tsao et al. | 347/74 |
| 4,596,990 | 6/1986 | Hou | 347/73 |
| 4,809,016 | 2/1989 | Padalino | 347/74 |

*Primary Examiner*—Stuart N. Hecker
*Attorney, Agent, or Firm*—Barbara Joan Haushalter

[57] ABSTRACT

A continuous linear array ink jet apparatus deposits a predetermined amount of printing fluid of at least one color onto a linear array of pixels at high resolution. The continuous ink jet system includes a linear array of orifices fluidically connected to a fluid supply, for producing a linear array of jets. The jets are stimulated for regular break-up of each jet into a plurality of uniform streams of drops. A linear array of planar conducting elements, disposed along a path of motion of the array of jets, deflects the print drops into at least two print positions. The linear array of planar conducting elements is situated at a predefined angle with the motion of the print medium so that the resolution of the print system is substantially higher than the number of jets per inch along the array.

18 Claims, 4 Drawing Sheets

| TWO-ROW PRINTHEAD CALCULATIONS | | | |
|---|---|---|---|
| RESOLUTION = 600 [dpi] | | PRINTHEAD LENGTH = 9.067 [inches] | |
| PIXELS [n] | ALLOWED ANGLES [deg] | ROW SPACING [mils] | PRINT SWATH [inches] |
| 1 | 45.0 | 2.4 | 6.41 |
| 2 | 26.6 | 3.7 | 8.11 |
| 3 | 18.4 | 5.3 | 8.60 |
| 4 | 14.0 | 6.9 | 8.80 |
| 5 | 11.3 | 8.5 | 8.89 |
| 6 | 9.5 | 10.1 | 8.94 |
| 7 | 8.1 | 11.8 | 8.98 |
| 8 | 7.1 | 13.4 | 9.00 |
| 9 | 6.3 | 15.1 | 9.01 |
| 10 | 5.7 | 16.8 | 9.02 |
| 11 | 5.2 | 18.4 | 9.03 |
| 12 | 4.8 | 20.1 | 9.04 |
| 13 | 4.4 | 21.7 | 9.04 |
| 14 | 4.1 | 23.4 | 9.04 |
| 15 | 3.8 | 25.1 | 9.05 |

FIG. 3

TWO ROW FLAT FACE CHARGING FOR HIGH RESOLUTION PRINTING

TECHNICAL FIELD

The present invention relates to continuous ink jet imaging and, more particularly, to high speed systems which utilize a linear array of jets at resolutions greater than about 100 jets per inch.

BACKGROUND OF THE INVENTION

In continuous ink jet printing, ink is supplied under pressure to a manifold region that distributes the ink to a plurality of orifices, typically arranged in a linear array(s). The ink discharges from the orifices in filaments which break into droplet streams. The approach for printing with these droplet streams is to selectively charge and deflect certain drops from their normal trajectories. Graphic reproduction is accomplished by selectively charging and deflecting drops from the drop streams and depositing at least some of the drops on a print receiving medium while other of the drops strike a drop catcher device. The continuous stream ink jet printing process is described, for example, in U.S. Pat. Nos. 4,255,754; 4,698,123 and 4,751,517, the disclosures of each of which are totally incorporated herein by reference.

The commercial state of the art in continuous binary array ink jet technology allows printing at 240 dots per inch. This is done with a linear array of jets, in which the spatial density of jets is the same as the print resolution, such as is disclosed in U.S. Pat. No. 4,636,808. In such technology, a plurality of independently switchable sources of electrostatic potential are supplied to a plurality of charge leads. A catcher intercepts the slightly deflected streams of drops. The stream of ink is sucked away from the face of the catcher by vacuum. A film of ink is formed by the plurality of streams of drops impacting on the catcher. Deflected drops impact the catcher and merge together to form a film of ink on the catcher face.

With the ever increasing demand for improved image quality, there is a need to raise the print resolution to at least 600 dpi. Existing systems at 240 dpi have the inherent capability to be scaled to the higher print resolutions needed. However, practical problems have hindered the development of such systems. A 240 dpi continuous binary array system with flat face charging scheme described in the '808 patent, has 240 electrical charging leads per inch on the charge plate. To make a practical printer, each of these leads must be connected to external circuitry which supplies the imaging data. Making electrical connections to these leads, even at 240 dpi, is a major hindrance to further improvement of resolution. For interconnection to external circuitry, conducting traces "fan out" across the top of the charge plate, to an interconnection point, where the leads are much more widely spaced than they are at the active surface of the charge plate. That is, the spatial density of the traces decreases as they fan out towards the interconnection point. This is necessary because the current state of the art in connection technology allows only about one hundred connections per linear inch. For some applications, a resolution of 100 dots per inch (dpi) is adequate. Increasingly, however, the demand for higher print quality rules out the use of resolutions as low as 100 dpi. In some systems, such as are manufactured by Scitex Digital Printing, Inc., of Dayton, Ohio, a complex fan out system provides 2.4 inches of connection length for each inch of ink jet array. In this way, connections to 240 charge leads per inch is achieved with the commercially feasible interconnection density of 100 connections per inch. However, it is clear to those skilled in the art that solving the interconnection problem this way requires a much larger charge plate than is otherwise required for the technology. If the spatial density of electrodes on the active surface of the charge plate is 240 leads per inch, and the spatial density of the connection points is 100 connections per inch, then the charge plate tends to be two or three times deeper than it is wide. This, in turn, causes the printhead to be larger than the desirable size.

There are other known methods for solving the electrical interconnect problem. For example, an alternate approach to solving the interconnection problem is to fabricate multiple layer circuitry on the top of the charge plate. Then semiconductor chips can be placed on the top of the charge plate itself. The chips can be used to receive data on a bus in serial fashion, and distribute the data as charging voltages to the charging leads. However, there are inherent problems with this approach. For example, if the charge leads are damaged by use, which is often the case, the entire charge plate containing the expensive circuit must be thrown away, or technology must be devised to restore the damaged leads.

Another approach is known in the art for making connections to the charge leads. In this approach, a charge plate is built up in several layers, so that each layer has low spatial density connections to the external circuitry. For example, a 300 jet per inch charge plate could be built up in three layers. Each layer would comprise a set of parallel, linear, conductive traces, with 100 traces per linear inch across the layer. One end of each layer would be made available for external connections at 100 connection points per inch; and the opposite end of each layer would terminate at the active surface of the charge plate. Each succeeding layer would be made slightly shorter, so that at the interconnection end, a stepped set of layers would be available for interconnection with each interconnection point having 100 connections per inch. The active surface of the charge plate would be made up of a plurality of layers laminated together and manufactured to the appropriate mechanical dimensions for the active surface. The conductive traces for the active part of the charge plate would be placed on the active surface by an appropriate process, with alternate charge leads connecting to alternate layers. In this way, the interconnection process is transferred to the active surface of the charge plate. Unfortunately, in practice, fabrication of the laminated charge plate structure has been difficult and expensive. The net result is that no presently available technology for charge plate fabrication at high resolution is adequate.

There are other problems with extending the current technology to higher resolutions than three to four hundred jets per inch. For example, fabrication of orifice arrays with appropriate mechanical properties is very difficult. There are problems with either the cost or the efficacy of all technologies known for fabrication of such high density arrays of orifices. The fundamental problem is that as resolution increases, the hole size required does not shrink as fast as the spacing between holes.

Accordingly, there is a need for high speed printing at a resolution of 600 dpi, or higher, to produce enhanced image quality. There is also a need for technology which can remove the constraint on interconnection to the charge leads, so that higher resolution can be achieved. There is also a need for technology which can enable higher resolution printing without adding to the problems of making a row of jets at the high resolution required for printing. Finally, there is a need for a method which allows printing at high speed and high resolution with a compact printhead.

SUMMARY OF THE INVENTION

This need is met by the continuous ink jet system and method according to the present invention wherein a planar charging system charges drops to a plurality of charge levels, one of which causes the drops to be caught and discarded or recirculated for reuse, and the others of which deflect the drops to various print positions. The planar charging system is situated at a predefined angle with the motion of the print medium, so that resolution of the print system is substantially higher than the number of jets per inch along the array.

In accordance with one aspect of the present invention, an improved continuous linear array ink jet apparatus deposits a predetermined amount of printing fluid of at least one color onto a linear array of pixels at high resolution. The ink jet system comprises a chamber in fluidic connection to a source of pressurized print fluid; a plurality of orifices in fluidic connection with the chamber so as to form a linear array of essentially coplanar streams of print fluid from the orifices; stimulation means to synchronize the break-up of the streams of print fluid into uniform streams of uniformly spaced drops, the stimulation means responsive to signal means which insures that the stimulation occurs at a predetermined frequency, the stimulation means creating generally in phase drop break-up of neighboring streams; phase means responsive to the signal means to generate a reference signal in fixed relationship to the phase of the break-off of the plurality of jets in the neighborhood; image control means containing information necessary to print desired image pixel patterns, and operable to control a plurality of voltage source means wherein each voltage source means controls the charge on the drops issuing from a particular jet; a plurality of voltage source means responsive to the image control means and responsive to the reference signal and operable to provide a multiple of predetermined charge voltage levels corresponding to each of the plurality of drops, and using the reference signal to properly phase the charging voltages to the jet break-up; and planar charging means including a plurality of charging electrodes individually connected to the plurality of voltage means, each of the plurality of charging electrodes positioned in close proximity to the drop break-off point of one of the plurality of jets in the array, and operable to charge the drops to one of a set of predetermined levels according to the potential on the corresponding one of the plurality of charging electrodes. The improvement of the present invention comprises using the planar charging system to charge the drops to a plurality of charge levels, one of which causes the drops to be caught and discarded or recirculated for reuse, and the others of which deflect the drops to various print positions, the planar charging system being at a predefined angle with the motion of the print medium, so that resolution of the print system is substantially higher than the number of jets per inch along the array.

An object of the present invention is to provide a planar charging means situated to substantially increase print system resolution. It is a further object of the present invention to provide such a means for charging of systems which utilize a linear array of jets at resolutions greater than about 100 jets per inch. It is an advantage of the present invention that it produces enhanced image quality. It is a further advantage of the present invention that it removes the constraint on interconnection to the charge leads, so that the higher resolution can be achieved. Finally, it is an advantage of the present invention that it allows printing at high speed and high resolution with a compact printhead.

Other objects and advantages of the invention will be apparent from the following description and the appended claims.

BRIEF DESCRIPTION OF THE DRAWINGS

FIG. 3 is a table illustrating two-row printhead calculations associated with the angle technique of FIG. 2;

DETAILED DESCRIPTION OF THE INVENTION

Current printheads, manufactured in accordance with the technology described in U.S. Pat. No. 4,636,808, and incorporated herein by reference, can readily deflect the small drops required for high resolution by as much as ten to fifteen mils. It is possible to utilize existing technology to achieve multiple row printing with a single row of nozzles. Although many of the examples described herein relate to two row printing, it will be obvious to those skilled in the art that the concept of the present invention is also applicable to three or more rows. A single row of jets and a standard charge plate is used to charge drops to three, or more different charge levels. One charge level is used to deflect the drops into a catch position, while the remaining charge levels cause drop deflection to multiple print positions.

Figure 1:
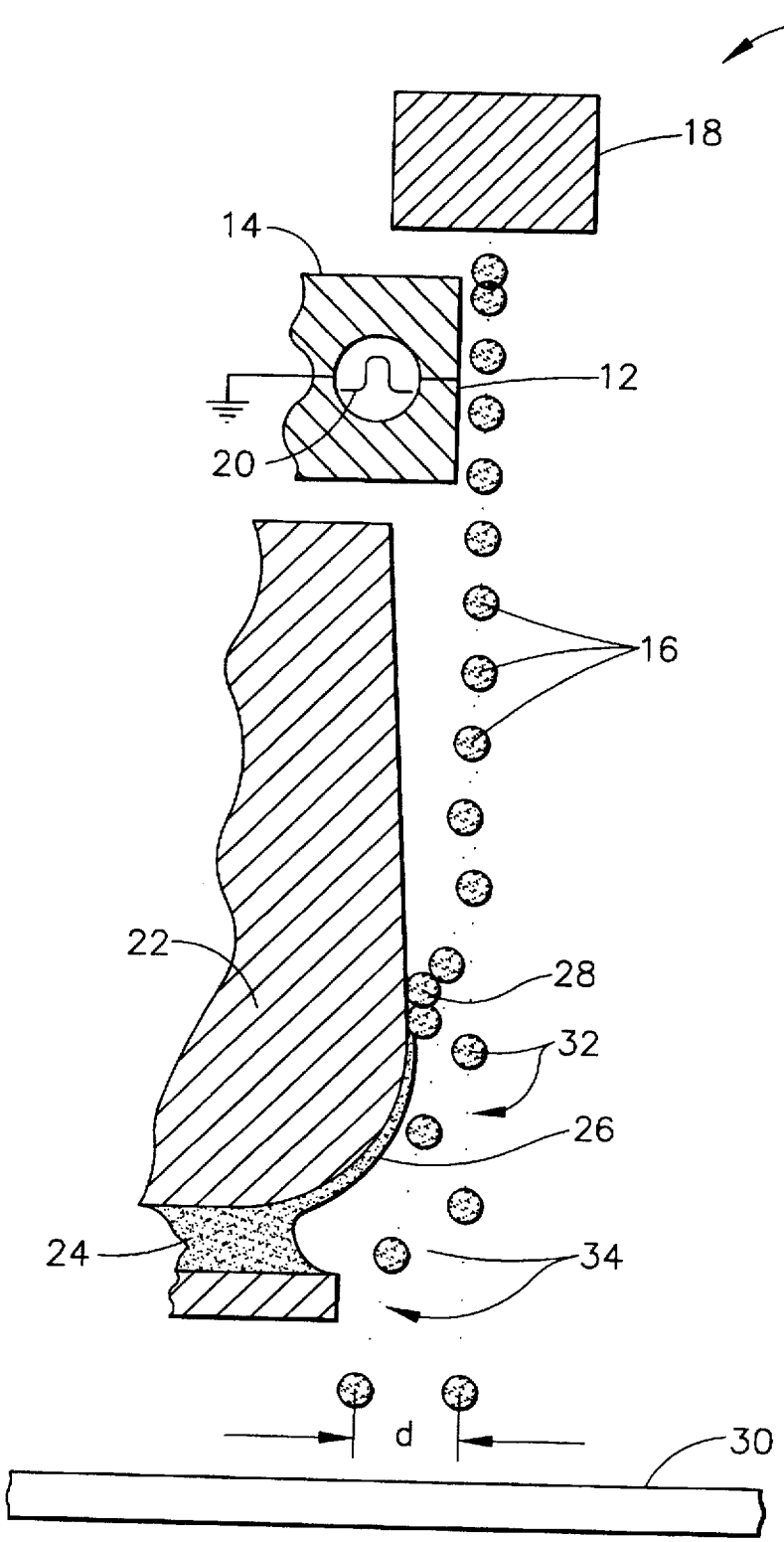
FIG. 1 is a side view of one embodiment of the present invention.

Referring now to the drawings, the present invention relates to the type of continuous ink jet system illustrated in FIG. 1. A plurality of jets is created at high spatial resolution by a drop generator, which stimulates the natural break-up of jets into uniform streams of droplets. In FIG. 1 there is illustrated one example of a three level charging system 10, in accordance with the present invention. A plurality of conducting elements, or charge leads 12, are located on a planar charge plate 14. A plurality of streams of drops 16 are supplied by drop generator 18. A plurality of independently switchable sources 20 of electrostatic potential are supplied to the plurality of charge leads 12. A catcher 22 intercepts the slightly deflected streams of drops. The plurality of streams of drops impacting on the catcher forms a film of ink 26, which in turn forms a flow of ink 24, sucked away from the face of the catcher by a vacuum. Reference number 28 represents the area on the catcher at which the deflected drops impact the catcher and merge together to form a film of ink on the catcher face. The undeflected ink drops then print the image on substrate 30.

Continuing with FIG. 1, the maximum charge level is sufficient to deflect the drops into the catcher surface. The momentum of the drops carries the fluid into a vacuum region which moves the fluid layer away from the print zone. The two charge layers which are not caught, form two rows of print drops 32 and 34, separated by a spacing distance d, at the substrate 30.

Figure 2:
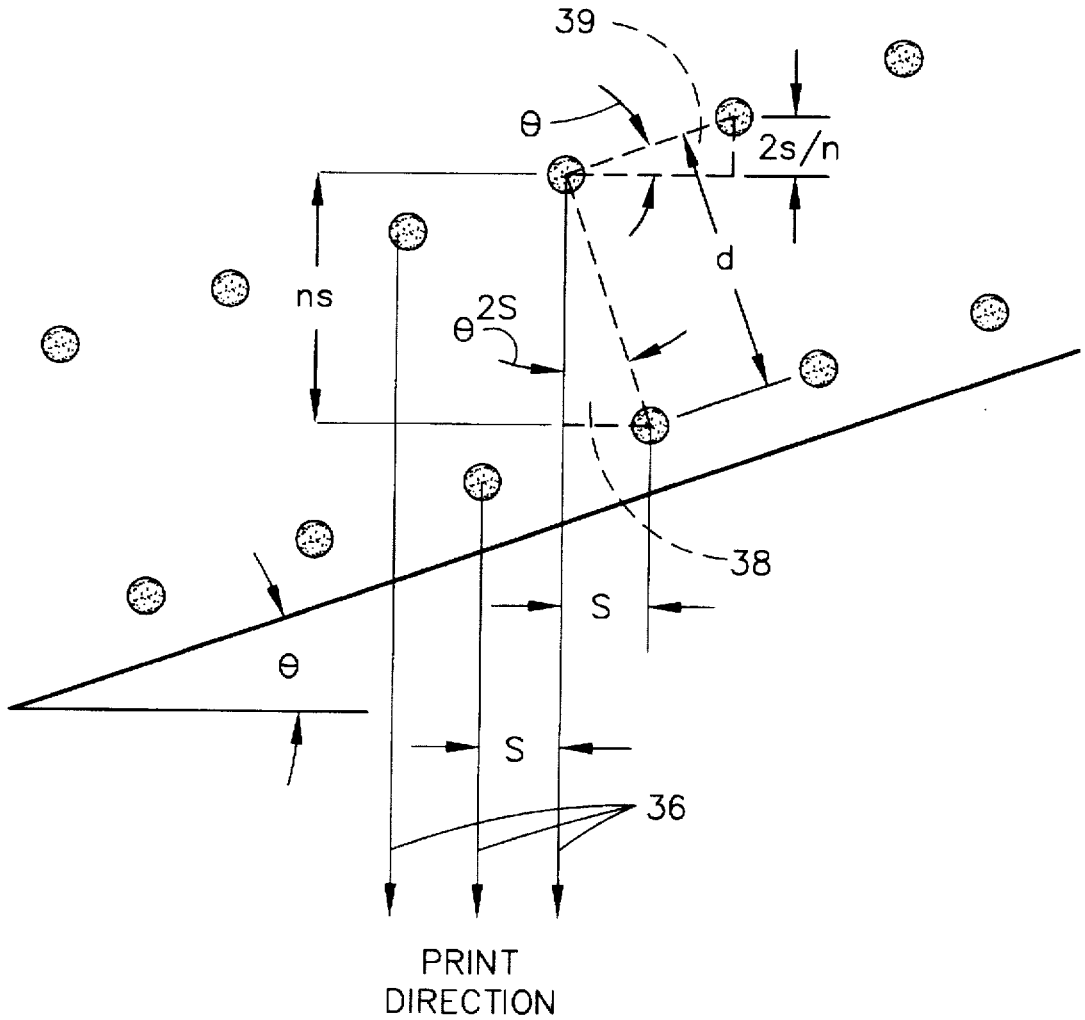
FIG. 2 is a droplet angle formation technique for using two rows of print drops to convert a given jet spacing into a different print resolution.

The two rows of drops 32, 34 are to be used to convert, for example, 300 dpi jet spacing into 600 dpi print resolution. This is done by forming an angle between the normal to the catcher and the print direction, as illustrated in FIG. 2, in a manner similar to that disclosed in U.S. Pat. Nos. 4,085,409 and 4,510,503, both of which are totally incorporated herein by reference. In FIG. 2, the printhead is situated at an angle θ, and produces two rows of print drops. The angle θ is chosen to cause a given jet spacing in two rows to print at a different resolution, for example, to print at twice the jet spacing resolution.

The two rows of deflected drops print with a resolution of at least 600 dpi based on an array of approximately 300 dpi.

A relationship exists between the spacing between the rows of print drops at the substrate, d, the pixel spacing, s, and the angle of the printhead, θ. An integral number of pixels between rows in the print direction occurs when:

$$\theta = \arctan(1/n) \quad n=1,2,3,\ldots \tag{1}$$

Assuming that the direction of substrate motion is downward, as illustrated by arrows 36 in FIG. 2, the spacing between print lines (1/600" in this example) is denoted as s. By similar triangles 38 and 39, it should be clear to persons skilled in the art that the spacing between the two rows of print drops is: ns/cosθ, and the spacing between jets is 2s/cosθ. In order to be able to synchronize the data output using conventional encoders and other components, the spacing between the jets in the print direction must be an integral number of pixels, as well, or at least a simple fraction of a pixel. Then, there are an integral number of tach pulses per pixel, and a tach pulse for selecting each drop. The triangle 38 illustrated by dotted lines in FIG. 2 defines the geometry for angle θ. In terms of printhead design, the choice of a row separation, d, determines a tradeoff between d, and the angle of the printhead, θ. In a printer, it is possible to lock the printhead at the correct angle and vary the second row deflection, or "d", for proper stitching between rows of drops.

Minimizing the drop separation increases the angle of tilt of the printhead, and requires a longer printhead for a given print swath. In order to quantify the tradeoff's among printhead length, deflection distance, drop placement, etc, it should be noted that:

$$d = s\sqrt{n^2+1} \tag{2}$$

Where s is the pixel spacing, the reciprocal of the resolution. From the triangle 38 illustrated in FIG. 2, it is clear that the angle for n=1 is 45°. The table of FIG. 3 gives angles, row spacings, and print swaths corresponding to row spacings from one pixel to 15 pixels.

As noted above, it is important to have the orifice to orifice distance along the print direction be either an integral number of pixels, or a fractional number of pixels (for example, ¼, ½, ⅓, etc.) An interesting choice is "n" equals eight pixels. Then the spacing along the print direction is ¼ pixel. This means that there is one tach pulse per print position when there are four tach pulses per pixel.

Figure 4:
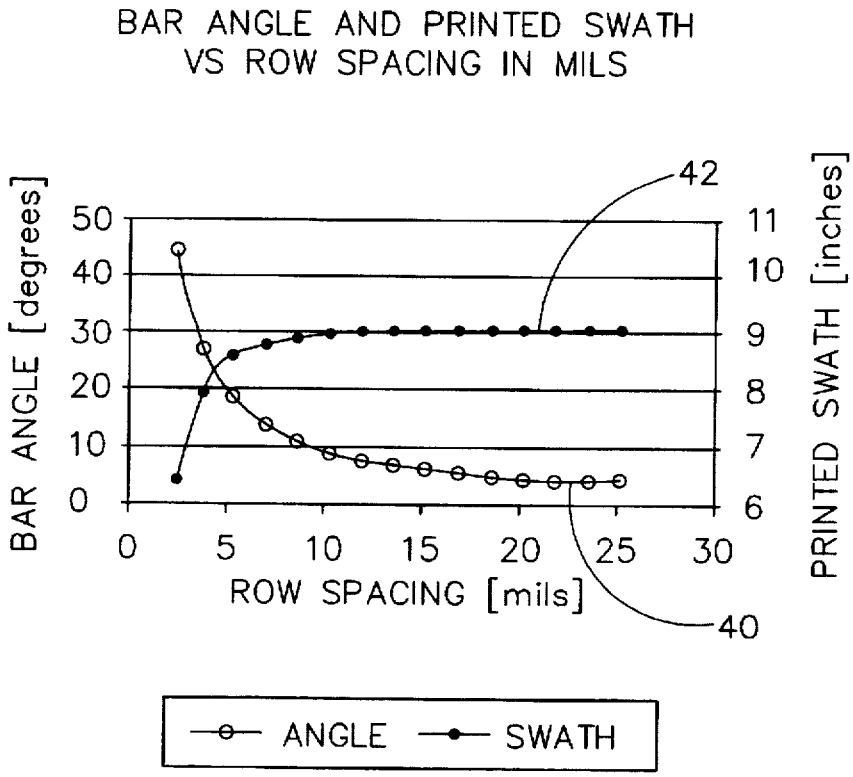
FIG. 4 is a graphical representation of bar angle and printed swath versus row spacing.

The quantized data from the table of FIG. 3 are plotted in FIG. 4. FIG. 4 includes an angle plot 40 and a swath plot 42. The row spacing on the x axis is in mils, but the data points are plotted to correspond to the integer pixel values. That is, the first value plotted corresponds to n=1. In that case, the row spacing, "d", is 2.36 mils, and the printhead angle is 45°. As n approaches 8, the printed swath 42 approaches nine inches using an example printhead length of 9.067 inches. The case for n=8 is the lowest value for which the print width is approximately nine inches. Also, the angle of the printhead is only 7.13 degrees. In that case, d=13.44 mils. This is a realistic deflection between the two rows of print drops. Incidentally, the jet spacing in the printhead for this case is 302.3 jets per inch.

Figure 5:
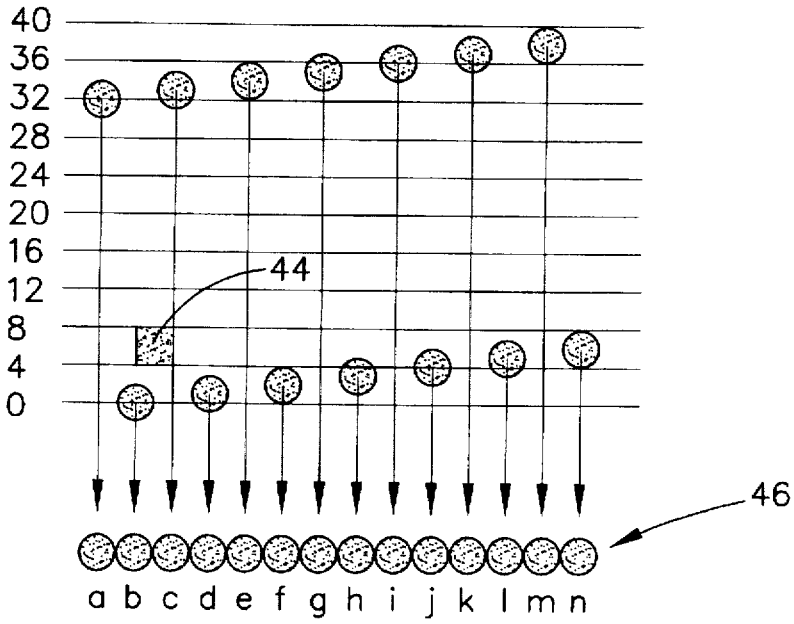
FIG. 5 is a graphical illustration showing the requirement for a multiplicity of tach signals per pixel.

A further illustrative example is given in FIG. 5, which shows the timing in the case where n=8. Each horizontal line in the figure represents the timing of one tach pulse. As previously described, this case requires four tach pulses per pixel in the print direction. Accordingly, FIG. 5 shows four tach pulses in the vertical direction by one "scan line" in the horizontal direction. The size of a pixel is represented graphically by shaded square 44. In this example, the tach pulses are labeled from one to forty. If it is required to print a horizontal row of drops 46, as is illustrated at the bottom of FIG. 5, the imaging electronics must properly organize the image data to accomplish that task. In this case, the first drop to be printed is the first drop in the bottom print row (counting the drops in each row from left to right.) The result is drop "b". In FIG. 5, all the bottom row drops in this drawing will print before any of the top row drops. This is because FIG. 5 only shows a limited section of the print width of the printhead. Since the drops are only separated by ¼ of a pixel, along the printhead, and the rows are separated by 8 pixels, the figure would need to show 32 drops before drop "a" in the horizontal line would print.

Industrial Applicability and Advantages

The present invention is useful in the field of ink jet printing, and has the advantage of providing a planar charging means situated to substantially increase print system resolution. It is a further advantage of the present invention that it provides a charging means which utilizes a linear array of jets at resolutions greater than about 100 jets per inch. It is an advantage of the present invention that it produces enhanced image quality. It is a further advantage of the present invention that it removes the constraint on interconnection to the charge leads, so that the higher resolution can be achieved. Finally, it is an advantage of the present invention that it allows printing at high speed and high resolution with a compact printhead.

The invention has been described in detail with particular reference to certain preferred embodiments thereof, but it will be understood that modifications and variations can be effected within the spirit and scope of the invention.

Claims:

1. A continuous ink jet system comprising:

a linear array of multiple rows of orifices fluidically connected to a fluid supply;

pressurization means to produce a linear array of a single row of jets;

stimulation means for stimulating jets of the array of jets for regular break-up of each jet into a plurality of uniform streams of drops;

planar charging means having a linear array of planar conducting elements disposed along a path of motion of the array of jets; and means for situating the planar charging means at a predefined angle with the motion of the print medium to affect print resolution.

2. A continuous ink jet system as claimed in claim 1 wherein the planar charging means charges the drops to a plurality of charge levels, one of the plurality of charge levels for causing the drops to be caught and discarded or recirculated for reuse, and the others of the plurality of charge levels for deflecting the drops to various print positions.

3. A continuous ink jet system as claimed in claim 1 wherein the print resolution is greater than 240 dots per inch.

4. A continuous ink jet system as claimed in claim 1 wherein said stimulation means are responsive to signal means for causing stimulation to occur at a predetermined frequency, the stimulation means creating generally in phase drop break-up of neighboring streams.

5. A continuous ink jet system as claimed in claim 4 further comprising phase means responsive to the signal means to generate a reference signal in fixed relationship to the phase of the break-off of the plurality of jets in the neighborhood.

6. A continuous ink jet system as claimed in claim 1 wherein the drops are charged to a plurality of levels so that a resulting resolution is at least twice a spatial density of the jets.

7. A continuous ink jet system as claimed in claim 6 wherein the plurality of levels comprises three levels.

8. A continuous ink jet system as claimed in claim 6 wherein jet to jet spacing in a direction of substrate motion comprises a fraction of a pixel, with a numerator of the fraction being one.

9. A continuous ink jet system as claimed in claim 6 wherein jet to jet spacing in a direction of substrate motion comprises an irreducible fraction of a pixel, with a numerator of the fraction being two.

10. A continuous ink jet system as claimed in claim 6 wherein spacing between deflection positions in a direction of substrate motion comprises an integral number of pixel spacings.

11. A continuous ink jet system as claimed in claim 10 wherein the integral number is equal to or greater than one.

12. A continuous ink jet system as claimed in claim 1 further comprising image control means containing information necessary to print desired image pixel patterns.

13. A continuous ink jet system as claimed in claim 12 wherein said image control means are operable to control a plurality of voltage source means.

14. A continuous ink jet system as claimed in claim 3 wherein each voltage source means controls the charge on the drops issuing from a particular jet.

15. A continuous ink jet system as claimed in claim 13 wherein the plurality of voltage source means is responsive to the image control means and a reference signal and operable to provide a multiple of predetermined charge voltage levels corresponding to each of the plurality of drops.

16. A continuous ink jet system as claimed in claim 13 wherein the plurality of voltage source means further comprises means for using a reference signal to properly phase the charging voltages to the jet break-up.

17. A continuous ink jet system as claimed in claim 13 wherein the planar charging means comprises a plurality of charging electrodes individually connected to the plurality of voltage means, each of the plurality of charging electrodes positioned in close proximity to the drop break-off point of one of the plurality of jets in the array.

18. A continuous ink jet system as claimed in claim 17 wherein the planar charging means are operable to charge the drops to one of a set of predetermined levels according to the potential on the corresponding one of the plurality of charging electrodes.

* * * * *